US007152941B2

(12) United States Patent
Johnson

(10) Patent No.: US 7,152,941 B2
(45) Date of Patent: Dec. 26, 2006

(54) PRINTING SYSTEM CALIBRATION

(75) Inventor: David A. Johnson, Boise, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 225 days.

(21) Appl. No.: 10/695,492

(22) Filed: Oct. 28, 2003

(65) Prior Publication Data

US 2005/0088476 A1 Apr. 28, 2005

(51) Int. Cl.
*B41J 29/393* (2006.01)

(52) U.S. Cl. ..... 347/19

(58) Field of Classification Search ..... 347/177–178, 347/240, 251–254, 228, 19, 151; 382/162–167, 382/168–172; 358/1.9; 399/49; 430/107.1
See application file for complete search history.

(56) References Cited

U.S. PATENT DOCUMENTS

| | | | | |
|---|---|---|---|---|
| 3,995,958 | A | 12/1976 | Pfahl et al. | 356/408 |
| 4,286,868 | A | 9/1981 | Laska | 355/68 |
| 5,068,810 | A | 11/1991 | Ott | 382/112 |
| 5,272,518 | A | 12/1993 | Vincent | 356/405 |
| 5,416,613 | A | 5/1995 | Rolleston et al. | 358/518 |
| 5,483,360 | A | 1/1996 | Rolleston et al. | 356/518 |
| 5,649,073 | A | 7/1997 | Knox et al. | 358/518 |
| 5,739,927 | A | 4/1998 | Balasubramanian | 358/518 |
| 5,760,913 | A | 6/1998 | Falk | 382/167 |
| 5,818,960 | A | 10/1998 | Gregory, Jr. et al. | 382/167 |
| 5,956,469 | A | 9/1999 | Liu et al. | 358/1.9 |
| 6,628,426 | B1 * | 9/2003 | Denton et al. | 358/1.9 |
| 6,697,582 | B1 * | 2/2004 | Scheuer | 399/49 |
| 2003/0128381 | A1 * | 7/2003 | Zaime | 358/1.9 |
| 2003/0133138 | A1 * | 7/2003 | Namikata | 358/1.9 |

* cited by examiner

*Primary Examiner*—Hai Pham

(57) ABSTRACT

In an implementation of printing system calibration, a calibration system measures colorant levels of a colorant applied to a test element, measures color values of the colorant applied to a print media after the colorant is in the finished state, and establishes a correlation between the measured colorant levels and the measured color values. Further, the calibration system converts the measured colorant levels to corresponding predicted color values based on the correlation, compares the predicted color values to target color values, and calibrates a print unit if a difference between the predicted color values and the target color values exceeds a threshold value.

36 Claims, 9 Drawing Sheets

PRINTING SYSTEM CALIBRATION

TECHNICAL FIELD

This invention relates generally to color printing systems and, in particular, to printing system calibration.

BACKGROUND

Color variation in printed materials can be a major source of dissatisfaction with users of color printers. Color variation occurs when a particular color appears in a printed document at a color value that is more or less than a desired target value for that color. A major source of color variation is inconsistent and/or improper amounts of colorant present on the printed document. Current printers attempt to maintain color variation tolerances within desired thresholds for printed materials through the use of calibration systems.

Current printers are unable to consistently maintain color variation tolerances within desired thresholds in printed materials without the use of expensive and cumbersome calibration systems. Some of these systems involve manual interaction by a user of a printing device. For example, sheets of paper may need to be fed through the printing device feeder while the device generates test patterns on a printable media. Such calibration processes are disruptive and delay printing because they are normally performed between print jobs which interrupts printing performance. Such calibration techniques are also costly because sheets of paper are used to perform the closed loop calibration. Consequently, calibration processes involving manual interaction are usually performed infrequently over longer periods of time, and only after noticeable color value drifts in documents.

Other calibration processes include testing on some type of a test element, such as a transfer belt, which is internal to a printing device. Using a transfer belt to perform a calibration process, however, is prone to inaccuracies because results obtained from measuring colorant levels applied to a transfer belt may vary significantly from actual color values output by a printing device on printed material. There can be measurable differences between colorants printed on a calibration element when compared to the colorants printed on a printable media that is output by the printing device. Moreover, internal calibration processes usually rely on static parameters established at a time when a printing device is manufactured and do not account for behavior differences associated with the printing device over time. The behavior differences can be caused by many factors, such as environmental fluctuations (e.g., temperature, atmospheric pressure, humidity, etc.), different types of print media, different types of ink, and/or changes to print elements due to wear.

As a result, current printers are often unable or versatile enough to maintain desired color values within desired tolerances. Attempts have been made to correct for these calibration inadequacies, but they are typically too complex, too expensive, and/or require too much user interaction with the printing device.

BRIEF DESCRIPTION OF THE DRAWINGS

The same numbers are used throughout the drawings to reference like features and components.

DETAILED DESCRIPTION

Figure 1:
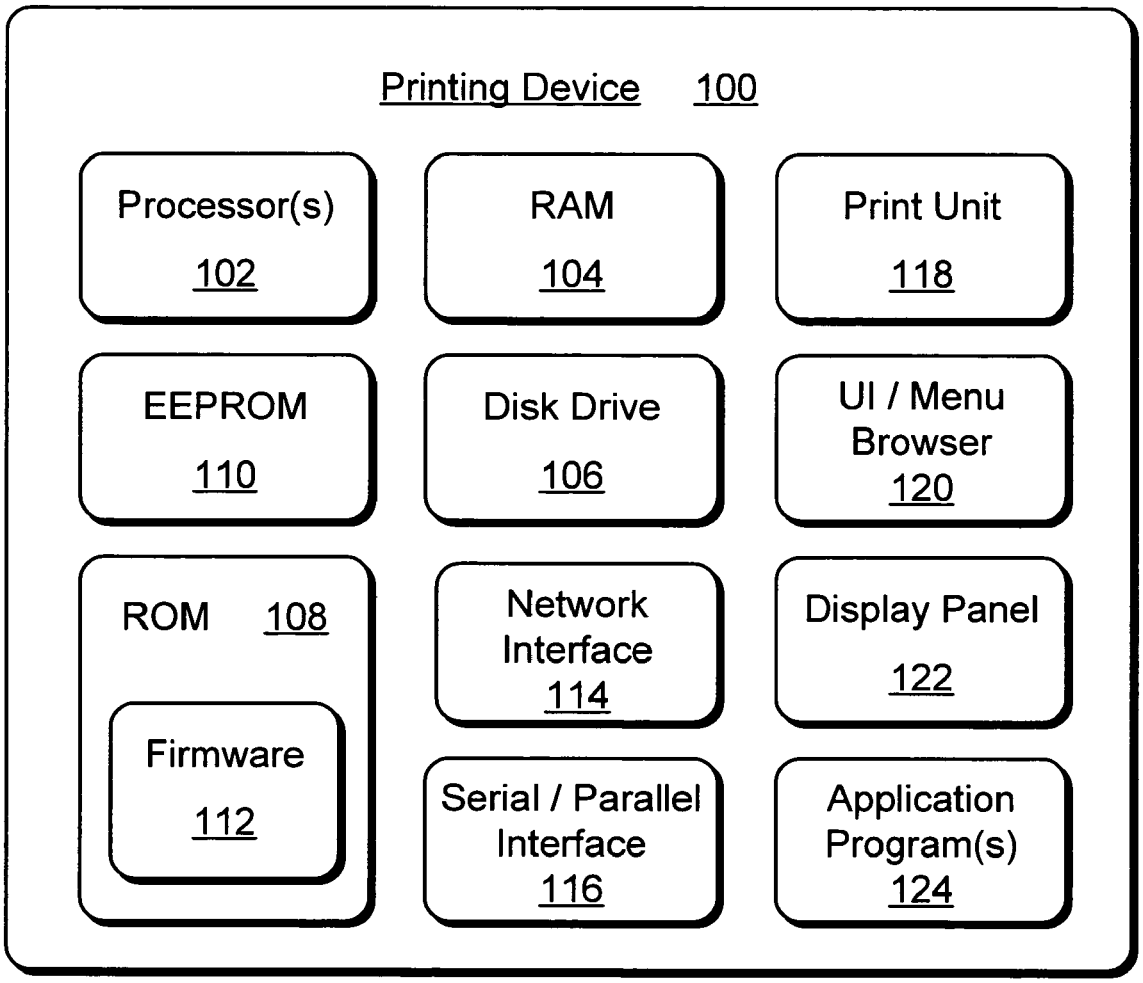
FIG. 1 illustrates various components of an exemplary printing device in which printing system calibration can be implemented.

The following describes printing system calibration. In an implementation, colorant levels of a colorant are measured when the colorant is applied to a test element. Color values of the colorant are then measured after the colorant is applied to a print media and fused, or after some other related process in which the colorant is fixed to the print media in a finished state. A correlation between the measured colorant levels (as applied to the test element) and the measured color values (as applied to the print media) is then established.

In an alternative and/or additional implementation of printing system calibration, colorant levels of a colorant are measured when the colorant is deposited on a test element An established correlation between colorant levels and color values is used to convert the measured colorant levels to predicted color values. The established correlation may be set during manufacture of the printing system, may be the correlation established as described above with reference to the first implementation, and/or may be established otherwise by the printing system. The predicted color values are then compared to target color values to determine whether the predicted color values are within a threshold. If not, the printing system can be recalibrated to adjust the colorant level of the colorant for printing use.

Subsequent calibrations of the printing system can be performed by utilizing only measured colorant levels of the colorant deposited on the test element without having to print a test page (e.g., a print media). These subsequent calibrations can be performed transparent to a user of the printing device when calibrating a laser printer, for example, because toner deposited onto the test element for a colorant level measurement can be cleaned off before the toner is fused or otherwise formed as a permanent image on a print media, for example. Providing that the predicted color values (as converted from the measured colorant levels) remain within a threshold level, the subsequent internal calibrations do not require printing a test print media to further calibrate the printing system.

As used herein, "colorant level" describes a physical quantity of a colorant at some point in a printing process prior to being produced in a finished state on a printed media. Typically, the colorant level is obtained by a sensing system that determines the mass of a colorant per unit area on some type of test medium, such as a transfer belt, a print media transport belt, pre-fused media, or other form of test media.

Further, as used herein, "color value" describes how a color appears in a finished state on a printed media. The color value can be measured by one or more devices that measure colorimetric properties with respect to how people observe colorants in a finished state. Spectrophotometers, calorimeters, densitometers, and other related devices measure the colorimetric properties to determine color values. A color value is affected by the colorant level, and may also be affected by media properties such as subtleties of how the colorant is distributed on a printed media, the surface finish of a finished document, interactions between two or more colorants that are combined to achieve a particular color value, and other factors.

FIG. 1 illustrates various components of an exemplary printing device 100 in which printing system calibration can be implemented. Printing device 100 includes one or more processors 102 (e.g., any of microprocessors, controllers, and the like) which process various instructions to control the operation of printing device 100 and to communicate with other electronic and computing devices.

Printing device 100 can be implemented with one or more memory components, examples of which include random access memory (RAM) 104, a disk drive 106, and non-volatile memory (e.g., any one or more or more of a ROM 108, flash memory, an electrically erasable programmable read-only memory (EEPROM) 110, and EPROM, etc.). The one or more memory components store various information and/or data such as configuration information, print job information and data, graphical user interface information, fonts, templates, menu structure information, and any other types of information and data related to operational aspects of printing device 100.

Printing device 100 includes a firmware component 112 that is implemented as a permanent memory module stored on ROM 108, or with other components in printing device 100, such as a component of a processor 102. Firmware 112 is programmed and distributed with printing device 100 (or separately such as in the form of an update) to coordinate operations of the hardware within the device and contains programming constructs used to perform such operations.

Printing device 100 further includes one or more communication interfaces which can be implemented as any one or more of a network interface 114, a serial and/or parallel interface 116, a wireless interface, and as any other type of communication interface. A wireless interface enables the printing device 100 to receive control input commands from an input device, such as from an infrared (IR), 802.11, Bluetooth, or similar RF input device. Network interface 114 provides a connection between printing device 100 and a data communication network which allows other electronic and computing devices coupled to a common data communication network to send print jobs, menu data, and other information to printing device 100 via the network. Similarly, the serial and/or parallel interface 116 provides a data communication path directly between printing device 100 and another electronic or computing device.

Printing device 100 also includes a print unit 118 that includes mechanisms arranged to selectively apply an imaging medium (e.g., liquid ink, liquid toner, dry toner, and the like) to print media in accordance with print data corresponding to a print job. Print media can include any form of media used for printing such as paper, plastic, fabric, Mylar, transparencies, and the like, and different sizes and types such as 8½×11, A4, roll feed media, etc. For example, print unit 118 can include an inkjet printing mechanism that selectively causes ink to be applied to a print media in a controlled fashion. The ink on the print media can then be more permanently fixed to the print media, for example, by selectively applying conductive or radiant thermal energy to the ink. There are many different types of print units available, and for the purposes of this discussion, print unit 118 can include any of these different types.

Printing device 100 also includes a user interface and menu browser 120, and a display panel 122. The user interface and menu browser 120 allows a user of the device 100 to navigate the device's menu structure. User interface 120 can include indicators or a series of buttons, switches, or other selectable controls that are manipulated by a user of the printing device. Display panel 122 is a graphical display that provides information regarding the status of printing device 100 and the current options available to a user through the menu structure.

Printing device 100 can include one or more application programs 124, such as an operating system, that can be stored in a non-volatile memory (e.g., ROM 108) and executed on processor(s) 102 to provide a runtime environment. A runtime environment facilitates extensibility of printing device 100 by allowing various interfaces to be defined that, in turn, allow the application programs 124 to interact with device 100.

Although shown separately, some of the components of printing device 100 can be implemented in an application specific integrated circuit (ASIC). Additionally, a system bus (not shown) typically connects the various components within printing device 100. A system bus can be implemented as one or more of any of several types of bus structures, including a memory bus or memory controller, a peripheral bus, an accelerated graphics port, or a local bus using any of a variety of bus architectures.

General reference is made herein to one or more printing devices, such as printing device 100. As used herein, a "printing device" means any electronic device having data communications, data storage capabilities, and/or functions to render printed characters and images on a print media. A printing device may be a fax machine, copier, plotter, and includes any type of printing device using a transferred imaging medium, such as ejected ink, to create an image on a print media. Examples of such a printing device can include, but are not limited to, laser printers, inkjet printers, plotters, portable printing devices, copy machines, network copy machines, printing systems, and multi-function or all-in-one combination devices. Although specific examples may refer to one or more of these printing devices, such examples are not meant to limit the scope of the claims or the description, but are meant to provide a specific understanding of the described implementations.

Figure 2:
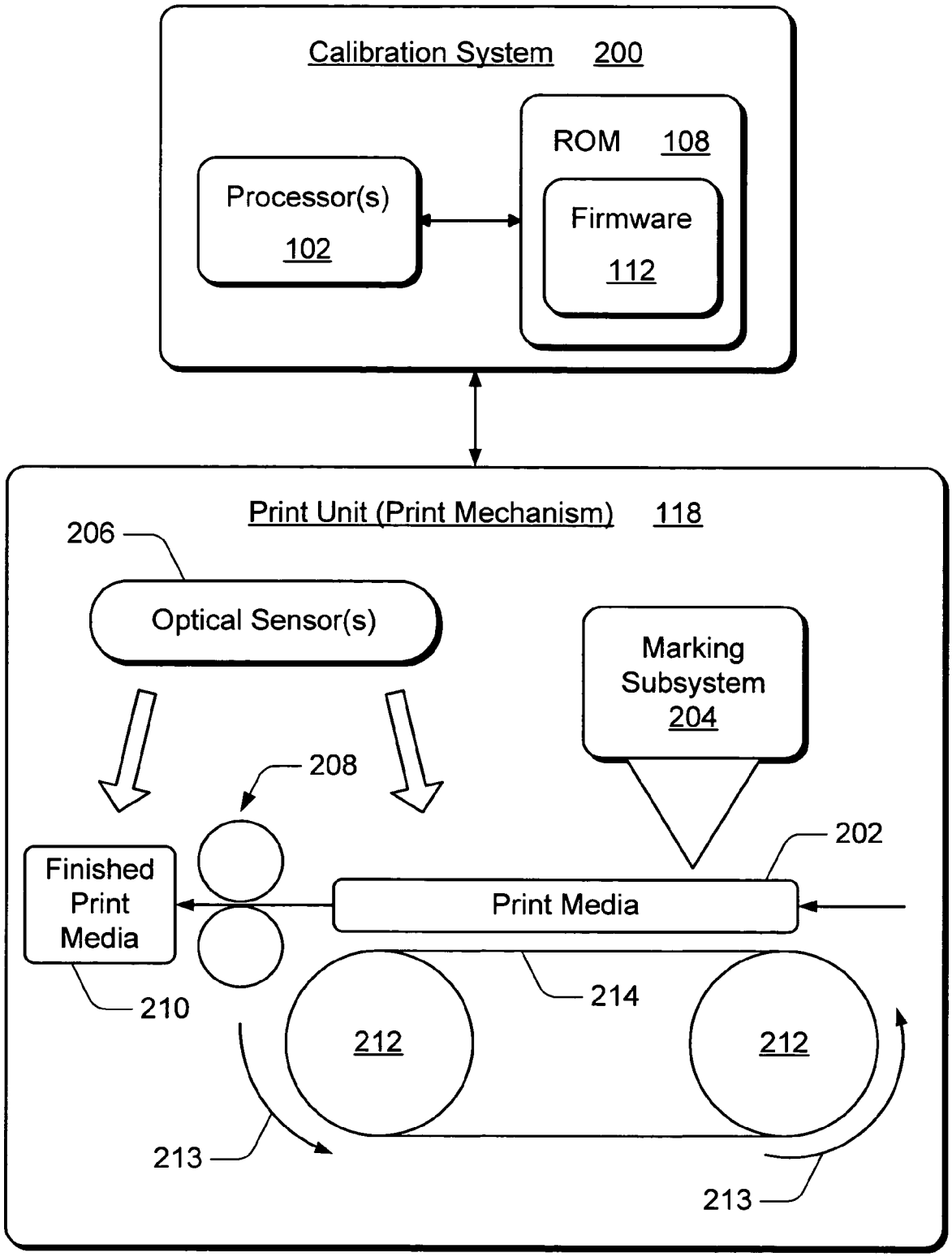
FIG. 2 illustrates exemplary printing device components including a calibration system and a print unit.

FIG. 2 illustrates various components of printing device 100, including a calibration system 200 and print unit 118. Although the print unit 118 is described as a component of a laser printer in this example, the print unit 118 can be implemented as a component of any other type of printing device as described above. Calibration system 200 performs calibration tests of print unit 118 and uses the results to calibrate the print unit. In this example, calibration system 200 includes processor(s) 102, memory (e.g., ROM 108), and firmware 112. Calibration system 200 controls calibration of the printing device 100 through the use of programmable logic and/or computer executable instructions maintained with ROM 108. Processor(s) 102 execute various instructions from ROM 108 or in the form of firmware 112 to control the operation of the printing device 100. In particular, calibration system 200 serves as a formatter to control print unit 118 and calibrations that are performed therein.

In other implementations, calibration system 200 can be implemented as any suitable hardware, firmware, software, or combination thereof. Further, a processor 102 in calibration system 200 can be implemented as any type of processing device including, but not limited to a state-machine, a Digital Signal Processor (DSP), an Application Specific Integrated Circuit (ASIC), or as one or more processor chips. Alternative types of computer-readable memory devices can be substituted for ROM 108 and/or firmware 112. Thus, the computer-executable instructions (including programmable logic) could also be stored on any alternative computer-readable media (e.g., RAM, DVD, Flash memory, etc.) including directly onto a programmable logic processor, such as a Programmable Logic Array (PLA), ASIC, and/or other programmable processing devices.

Print unit 118 generally includes the mechanical mechanisms arranged to selectively apply colorants in the form of liquid ink, liquid toner, dry toner, and the like to a print media 202 in accordance with print data corresponding to a print request. Print unit 118 includes a marking subsystem 204, one or more optical sensors 206, a fuser 208, rollers 212, and a test element 214. It is to be appreciated that print unit 118 is simplified for illustration purposes. Additional items can comprise the print unit 118 such as a motor (not shown) to drive the rollers 212. In this example, test element 214 is illustrated as a print media transport belt.

Marking subsystem 204 is used to apply a marking material (e.g., toner or ink which is a colorant of a particular color) to the print media 202 or to the test element 214. When performing calibrations, marking subsystem 204 is instructed by the calibration system 200 to print a series of half-toned test patches of one or more colorants on either the print media 202 or the test element 214. Alternatively other test patterns could be applied to either media.

Optical sensor(s) 206 can measure the colorant level of a colorant after it has been applied to the test element 214, or to the print media 202. In this example, an optical sensor 206 can be implemented as a densitometer, a colorimeter, a spectrophotometer, or as any other single or combinatory device capable of measuring the colorant level of colorants applied to a print media 202 and/or the test element 214. Alternatively, a sensor could be implemented as a non-optical mechanism capable of measuring the colorant level applied to the print media 202 and/or to the test element 214.

In this example, the single sensor 206 is positioned to sense, or otherwise measure, the colorant level of the colorant applied to the test element 214, and the color value of the colorant after being applied and formed as a permanent image on print media 210. The sensor 206 may also measure colorant levels of colorant applied to the print media 202 before passing through the fusing subsystem 208. In an event that the single sensor 206 is only able to sense colorants on the test element 214 and/or on the print media 202 prior to being formed as a permanent image, a user of the printer could be instructed to reinsert a finished page (or have the duplexer reroute a finished page twice), to ensure that the finished page passes through the entire printing unit such that sensor 206 measures the color value of the colorants after being formed as a permanent image (e.g., fused in a laser printer).

Alternatively, one sensor can be implemented to measure the colorant level of the colorant applied to the test element 214 and another sensor can be implemented to measure the color value of a colorant applied to a finished print media 210. For example, in an alternate implementation from that which is shown, a first sensor can be positioned to measure the colorant level of the colorant applied to test element 214 and also the colorant applied to the print media 202 before being formed as a permanent image. A second sensor can be positioned to measure the color value of the colorant in a finished state.

In another alternative implementation, the color value of a colorant on the finished print media 210 could be measured by a measurement device (not shown) external to printing device 100. The measured color value can then be communicated back the to the calibration system 200 for purposes of calibrating the print unit 118. This would involve transporting the finished print media 210 to the external measurement device from an output area of the printing device 100.

Fusing subsystem 208 fuses, ruptures, or melts polymeric resin in which the colorant is embedded and converts discrete toner particles into an amorphous film. This film becomes the permanent image that results in an electrophotographic copy or laser printed copy (e.g., finished print media 210). Alternatively, fusing subsystem 208 can be replaced by a liquid ink process, a chemical process, or by one or more other processes that apply colorant onto the print media 202 in a finished state.

Rollers 212 provide a mechanism for moving the test element 214 (e.g., the print media transport belt). When the rollers 212 are rotated in the direction indicated by arrows 213, the test element 214 rotates around the rollers 212 in the same direction. It is to be appreciated that the components shown in FIG. 2 are simplified and that devices such as pulleys, duplex mechanisms, clips, belts, and other related devices can be implemented in the print unit 118 to move the test element 214.

In the exemplary implementation, test element 214 is an electrostatic transport belt that permits images to be applied to the print media 202. Alternatively, test element 214 can be implemented as a photoconductive drum. When in the form of a transport belt, test element 214 may also serve to move the print media 202 through the print unit 118 from an input area (not shown) to an output area (not shown) of the printing device 100. Colorants can be applied to the test element 214 and the respective colorant levels can be measured by the sensor 206 to calibrate the print unit 118 in conjunction with other operations which are controlled by the calibration system 200, all of which shall be described in more detail below.

The calibration system 200 and the print unit 118 shown in FIG. 2 are exemplary. It is expected that various types of other print units as well as calibration system configurations can be implemented which are consistent with the techniques of the exemplary illustrations. While other specific configurations may be substituted for calibration system 200 and print unit 118, it is expected that these various configurations can be adapted to perform calibrations of printing devices in a similar fashion as described herein.

Figure 3:
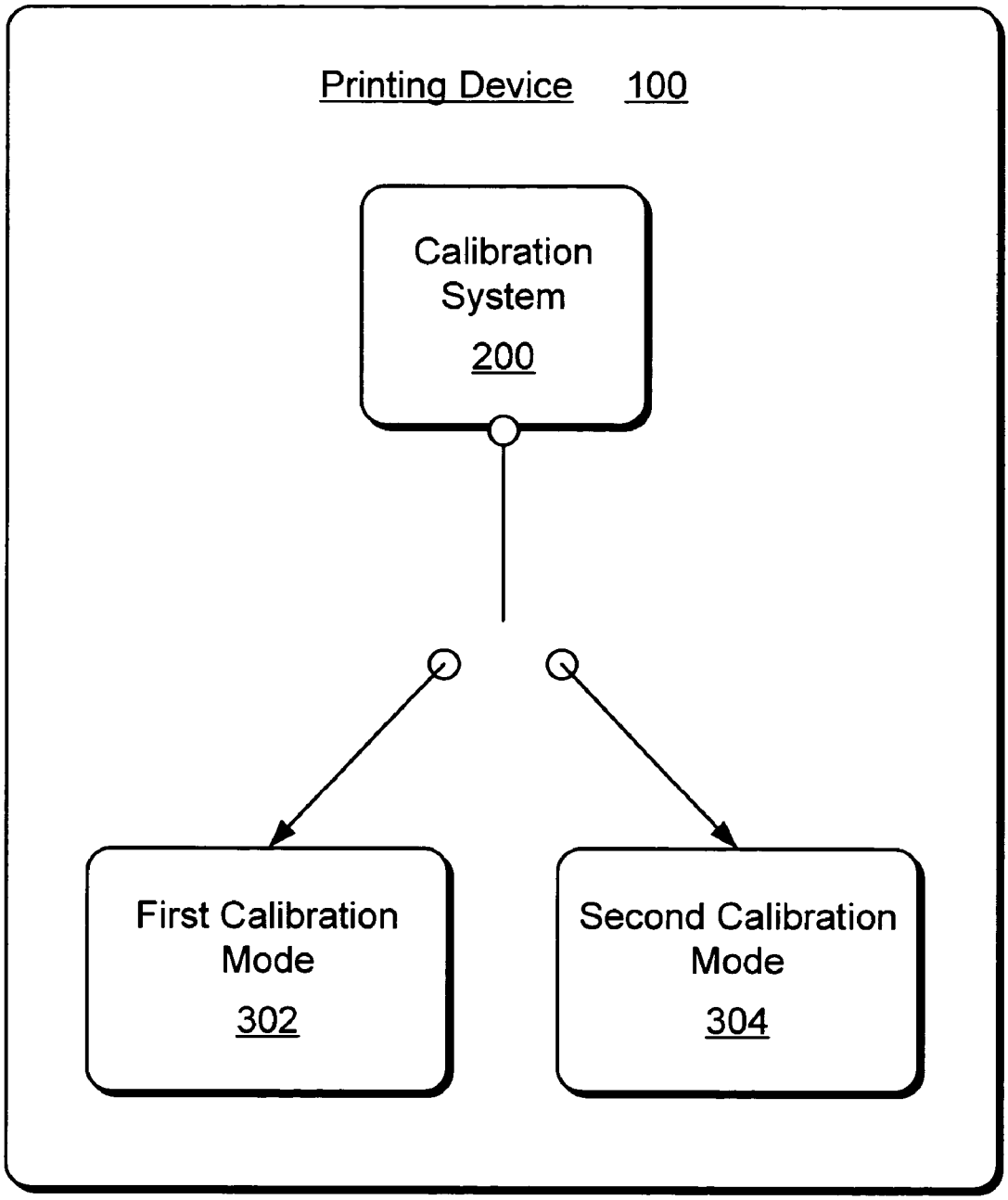
FIG. 3 illustrates a block diagram of an exemplary printing device having a calibration system that includes selectable first and second calibration modes.

FIG. 3 is a block diagram of printing device 100 having a calibration system 200 operable in a selectable one of at least a first calibration mode 302 and a second calibration mode 304. Both modes are utilized to calibrate printing device 100. In the first calibration mode 302, colorant levels of a colorant applied to a test element (e.g., a print media transport belt) are measured, an established correlation between colorant levels and color values is used to convert the measured colorant levels to predicted color values, and the predicted color values are compared to target color values to determine whether the predicted color values are within a threshold. If not, the print unit 118 can be recalibrated to adjust the colorant level of the colorant that is applied to the test element.

In the second calibration mode 304, a colorant is applied to a test element and colorant levels of the colorant are measured in a pre-fused state. The colorant may then be formed as a permanent image on the print media, and color values of the colorant in the finished state are measured. A correlation is then established between the measured colorant levels (as applied to the test element) and the measured color values (as applied to the print media). This established correlation can then be used to replace (e.g., update, revise, etc.) the established correlation in the first calibration mode 302.

Either of the calibration modes 302 and/or 304 can be selected via the user interface and menu browser 120 (FIG. 1), via a host device (not shown) in communication with the calibration system 200, or a calibration mode can be automatically scheduled depending on page usage of the printer or time scheduling. The user interface and menu browser 120, or commands sent to calibration system 200 via a host device, permits a user to select the second calibration mode 304. Alternatively, the second calibration mode can be automatically selected by the calibration system 200 according to default settings or customer preferred settings, the quantity of printed pages output by the printer for select intervals, and/or at scheduled times. Further, the second calibration mode 304 can be automatically selected when the established correlation between the measured colorant levels and the measured color values has degraded, or when irregularities are observed by the calibration system 200 in the first calibration mode 302.

Figure 4:
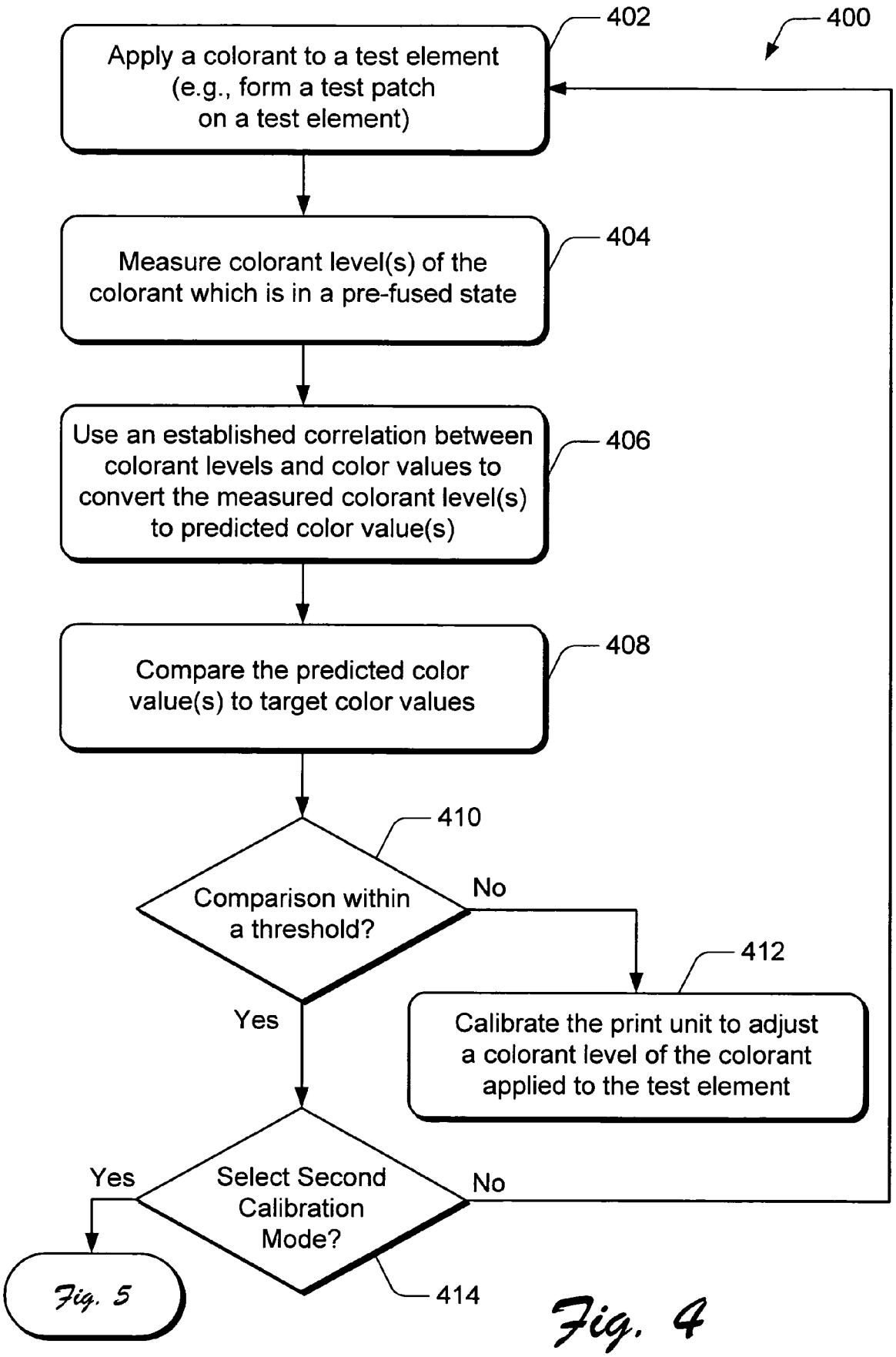
FIG. 4 is a flow diagram that illustrates an exemplary method for calibrating a printing device according to the first calibration mode.

FIG. 4 is a flow diagram that illustrates an exemplary method 400 for calibrating a printing system (e.g., the printing device 100) according to the first calibration mode 302 (FIG. 3). The order in which the method blocks are described is not intended to be construed as a limitation. Furthermore, the method 400 can be implemented in any suitable hardware, software, firmware, or combination thereof. In the exemplary implementation, method 400 is executed by the calibration system 200 in conjunction with the print unit 118 (FIG. 2).

At block 402, a colorant is applied to a test element. For example, print unit 118 can apply a colorant in the form of a colorant test patch on a test element, such as the print media transport belt 214. At block 404, colorant level(s) of the colorant applied to the test element are measured. For example, when a particular colorant is applied to a test element, the colorant level of the applied colorant is sensed, or otherwise measured, with optical sensor 206 (FIG. 2). The colorant can be applied as a series of half-toned patches or in some other format. Additionally, more than one colorant can be applied to the test element as a series of test patches spanning a range of target densities, but for purposes of simplifying this discussion, a single colorant in the form of single test patch shall be described.

At block 406, an established correlation between colorant levels and color values is used to convert the measured colorant level(s) to predicted color value(s) (i.e., if the same test patch were in a finished state on a print media). The correlation between colorant levels and color values can initially be established during manufacture of the printing device and encoded into a memory component of the calibration system 200 in the form of a value.

At block 408, the predicted color value(s) are compared to target color values (or intended color values) to determine whether the difference is greater than an acceptable threshold value established for the colorant. If the comparison is within the threshold (e.g., a difference between the predicted color value(s) and the target color values is not greater than the threshold value) (i.e., "yes" from block 410), then method 400 proceeds to block 414. If the comparison is not within the threshold (e.g., the difference between the predicted color value(s) and the target color values is greater than the maximum threshold value) (i.e., "no" from block 410), then method 400 proceeds to block 412.

At block 412, the print unit is calibrated to adjust (e.g., increase or decrease) a colorant level of the colorant applied to the test element. Alternatively, block 410 can be eliminated and the calibration system 200 can automatically recalibrate the print unit since the colorant calibration patches have already been printed and any difference between the predicted color value(s) (as converted from the measured colorant level(s)) and the target color values has been determined.

At block 414, a determination is made whether to select the second calibration mode (e.g., the calibration system 200 can determine whether to select the second calibration mode 304). If the second calibration mode 304 is not selected (i.e., "no" from block 414), then the printing device continues to periodically use the first calibration mode 302 to calibrate the print unit 118 when the calibration system 200 is initiated. However, if there is a desire to test whether the first calibration mode is accurately calibrating the printing device 100, then the second calibration mode 304 can be selected (i.e., "yes" from block 414).

Figure 5:
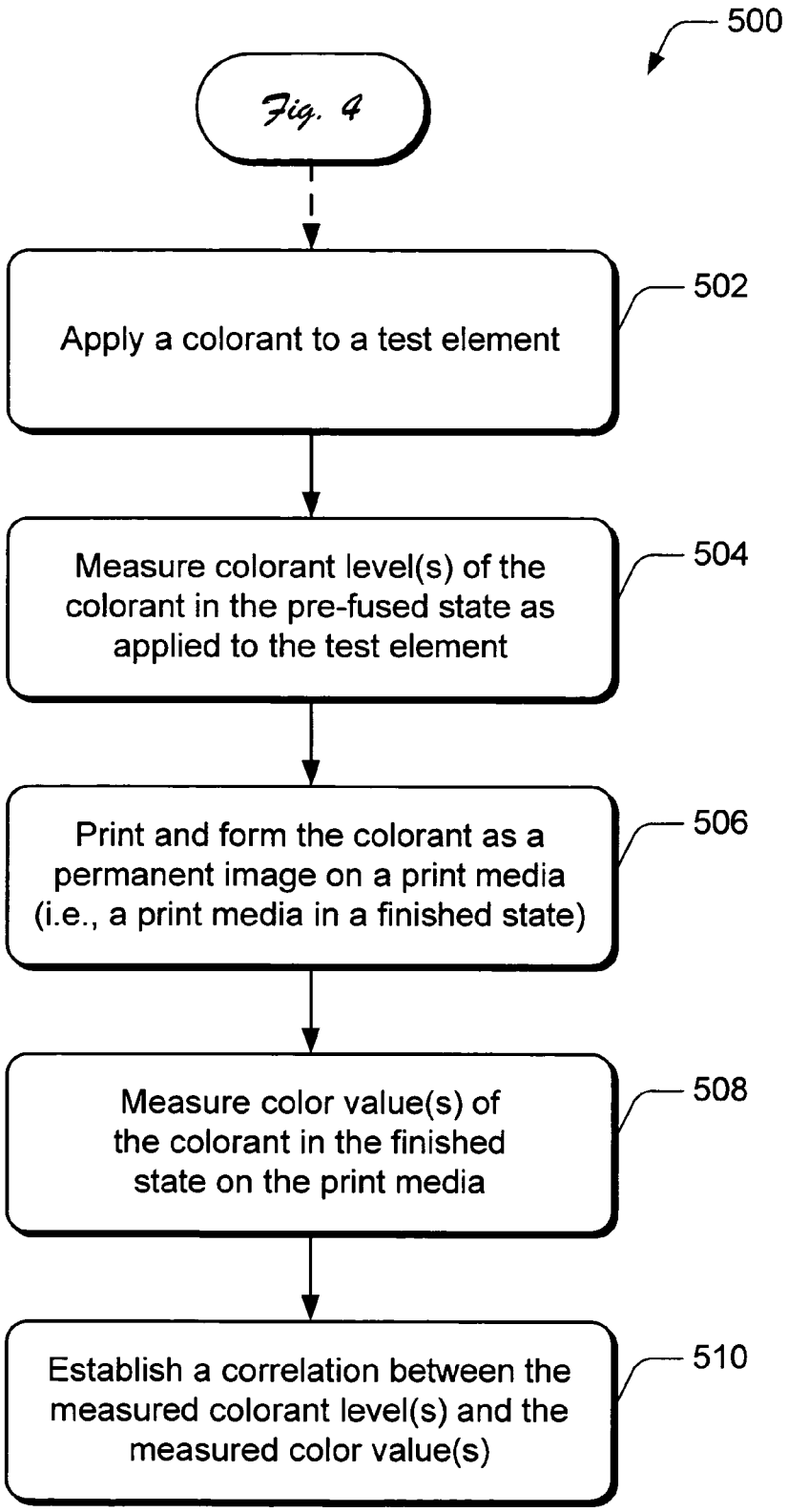
FIG. 5 is a flow diagram that illustrates an exemplary method for calibrating a printing device according to the second calibration mode.

FIG. 5 is a flow diagram that illustrates an exemplary method 500 for calibrating a printing system (e.g., the printing device 100) according to the second calibration mode 304 (FIG. 3). As described above, the second calibration mode 304 is used to establish a correlation between measured colorant level(s) and measured color value(s) such that the established correlation can be used in accordance with the first calibration mode 302 (i.e., at block 406 in FIG. 4). In an exemplary implementation, operations performed in the second calibration mode 304 are performed immediately after (although not required) measurements are completed for the first calibration mode 302 to ensure nearly identical operating conditions. The order in which the method blocks are described is not intended to be construed as a limitation. Furthermore, the method 500 can be implemented in any suitable hardware, software, firmware, or combination thereof. In the exemplary implementation, method 500 is executed by the calibration system 200 in conjunction with the print unit 118 (FIG. 2).

At block 502, a colorant is applied to a test element. For example, print unit 118 can apply the colorant as one or more test patches on a test element, such as print media transport belt 214. At block 504, colorant level(s) of the colorant applied to the test element are measured. For example, the colorant level may be sensed using the optical sensor 206 (FIG. 2).

At block 506, the colorant is printed and formed as a permanent image on a print media. The same test patches applied at block 502 are printed on a print media. At block 508, color value(s) of the colorant in the finished state are measured on the print media. This provides an accurate measurement of the color value of the colorant actually produced by the printing device 100.

At block 510, a correlation between the measured colorant level(s) and the measured color value(s) is established utilizing the colorant level measurements obtained at block 504 and the color value measurements obtained at block 508. This established correlation can then be used in the first calibration mode 302 (i.e., at block 406 in FIG. 4). For a period of time thereafter, only the pre-fused colorant level measurements from a test element need to be taken according to the first calibration mode 302 to calibrate the print unit 118. At a longer time interval, the correlation between measured colorant level(s) and measured color value(s) can be reestablished in accordance with calibration mode 304.

The second calibration mode 304 provides the advantage of making color value measurements of colorants applied to the print media in a finished state (e.g., a fused or equivalent state). Direct measurements of color values produced by colorants applied to the print media in a finished state eliminates the need to estimate what the color values would be, based on levels that are produced from measurements of colorant levels taken in a pre-fused state. These direct measurements result in tighter control over color value variations produced by a particular printing device.

Depending on the application, more than one sheet of print media can be used during calibration when the second calibration mode 304 is selected, or otherwise initiated. Additionally, the second calibration mode 304 and the first calibration mode 302 can be performed in several iterations, if necessary, to more accurately calibrate printing device 100.

While the description corresponding to FIGS. 4 and 5 describe selecting the first calibration mode 302 before the second calibration mode 304, the second calibration mode 304 can be implemented before the first calibration mode 304. Additionally, not all operations described in each block in FIGS. 4 and 5 need to be performed for each calibration process, nor must all of the blocks be conducted as one test, but can be individually performed at predetermined time intervals.

Figure 6A:
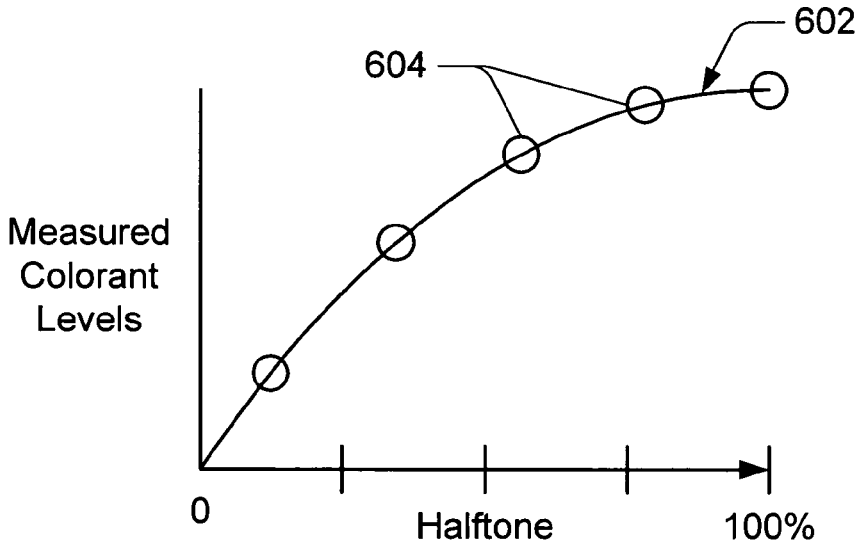
FIGS. 6A–6D illustrate an exemplary implementation of the first calibration mode.
Figure 6B:
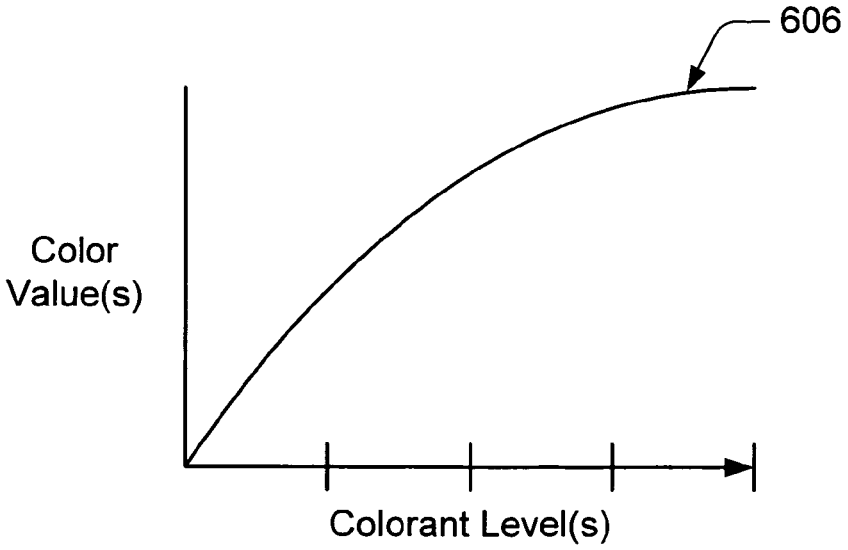

FIGS. 6A–6D illustrate an example of the first calibration mode 302 which is described with reference to method 400 (FIG. 4). In FIG. 6A, a curve fit 602 is generated that corresponds to measured colorant levels 604. For example, the colorant levels are measured when a colorant is applied to a test element and while the colorant is in a pre-fused, or not in a finished state (i.e., blocks 402 and 404 of method 400). In FIG. 6B, an established correlation 606 between colorant levels and color values is illustrated, and in FIG. 6C, the established correlation is utilized to convert the measured colorant levels 604 to predicted color values 608 along a curve fit 610 (i.e., block 406 of method 400).

The predicted color values 608 along curve fit 610 are compared to target color values along a target color value curve 612 (i.e., block 408 of method 400). The predicted color values 608 are converted from the measured colorant levels 604 (FIG. 6A) using the established correlation 606. An established correlation between colorant levels and color values is initially a static function of a printing device's characteristics which can be established when the printing device is manufactured.

Figure 6C:
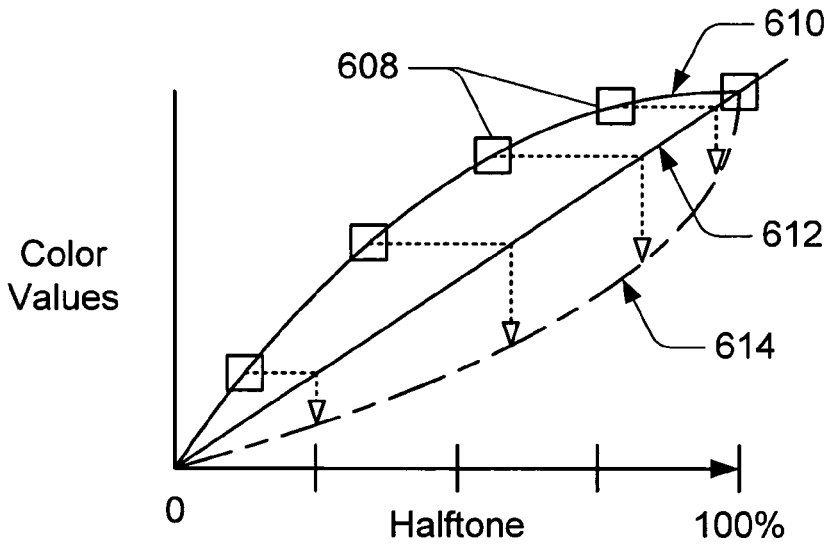
Figure 6D:
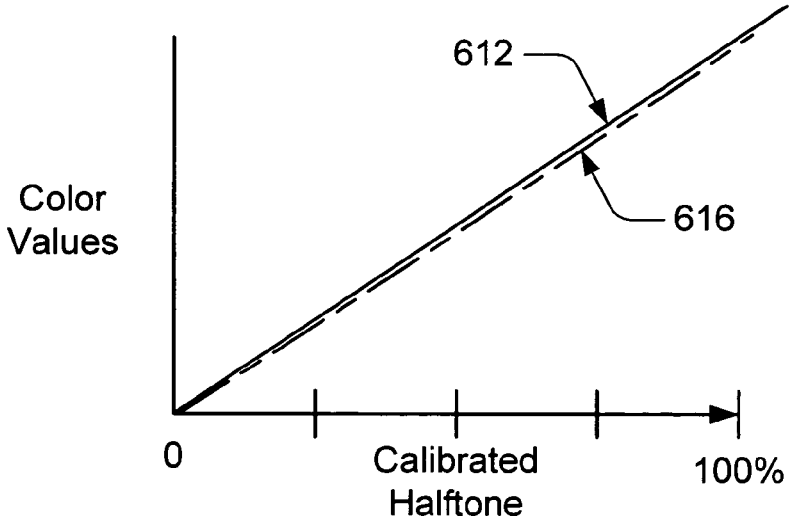

FIG. 6C also illustrates a calibrated halftone curve 614 which is an inverted curve that is generated to compensate for the displacement of the predicted color values 608 from the target color value curve 612. FIG. 6D illustrates that the calibrated halftone adjustments 614, when combined or averaged with the predicted color values 608, creates target color values along a target color value curve 616 that is substantially similar to the initial target color value curve 612 (i.e., blocks 410 and 412 of method 400).

Figure 7A:
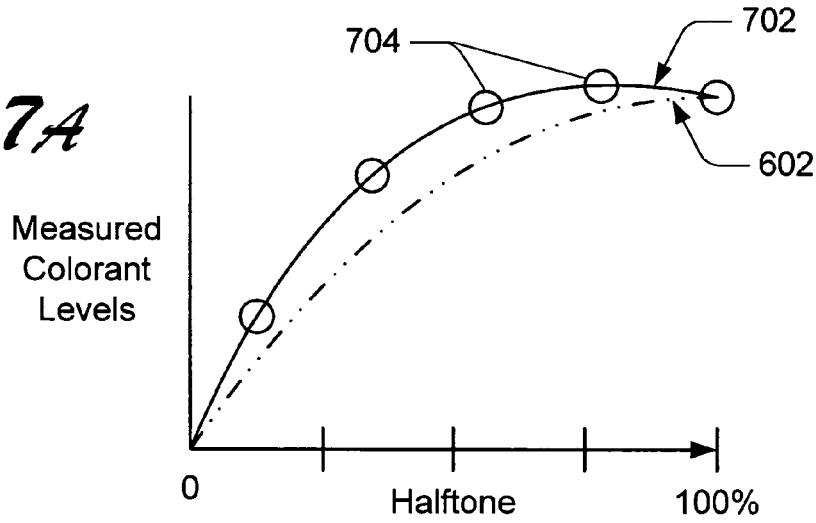
FIGS. 7A–7C further illustrate an exemplary implementation of the first calibration mode.
Figure 7B:
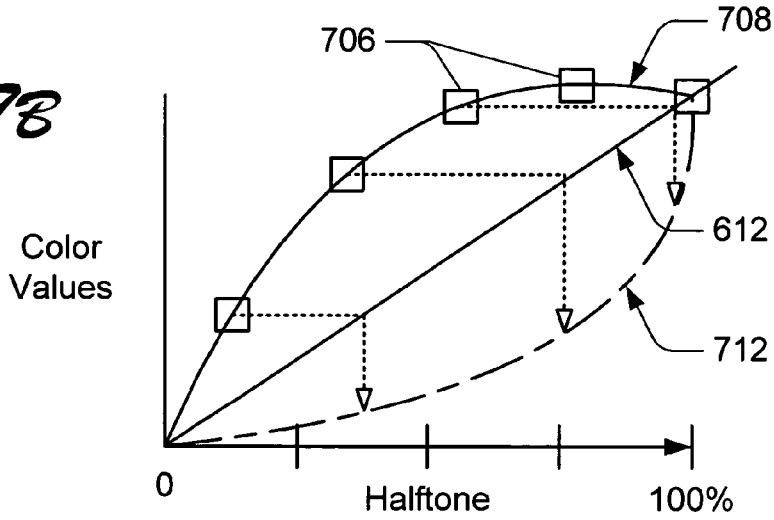
Figure 7C:
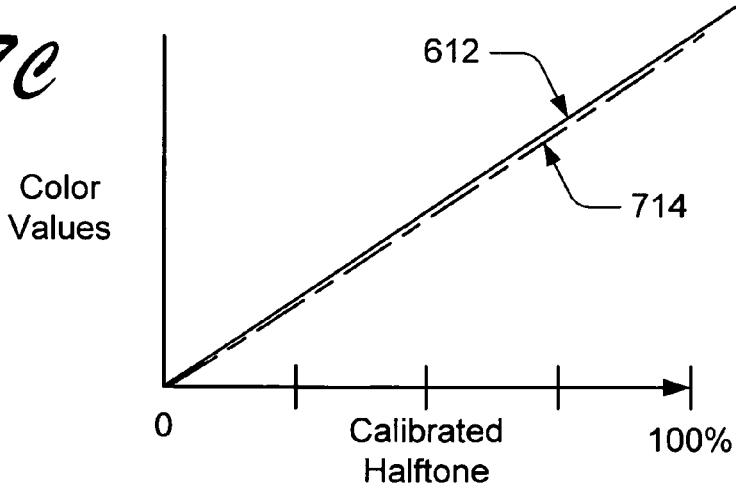

FIGS. 7A–7C further illustrate an example of the first calibration mode 302 when colorant levels are measured at a time after the calibration illustrated in FIGS. 6A–6D. In FIG. 7A, a curve fit 702 is generated that corresponds to measured colorant levels 704 which show that printing device 100 is now printing somewhat darker in the mid-tones than when colorant levels 604 were measured (i.e., comparing curve fit 702 to curve fit 602).

In FIG. 7B, the established correlation 606 (FIG. 6B) between colorant levels and color values is again utilized to convert the measured colorant levels 704 to predicted color values 706 along a curve fit 708 for comparison to the target color value curve 612. The predicted color values 706 along curve fit 708 are compared to target color values along the target color value curve 612. The predicted color values 706 are converted from the measured colorant levels 704 (FIG. 7A) using the established correlation 606 (FIG. 6B). A calibrated halftone curve 712 is generated to compensate for the displacement of the predicted color values 706 from the target color value curve 612. FIG. 7C illustrates that the calibrated halftone adjustments 712, when combined or averaged with the predicted color values 706, creates target color values along a target color value curve 714 that is substantially similar to the initial target color value curve 612.

Figure 8A:
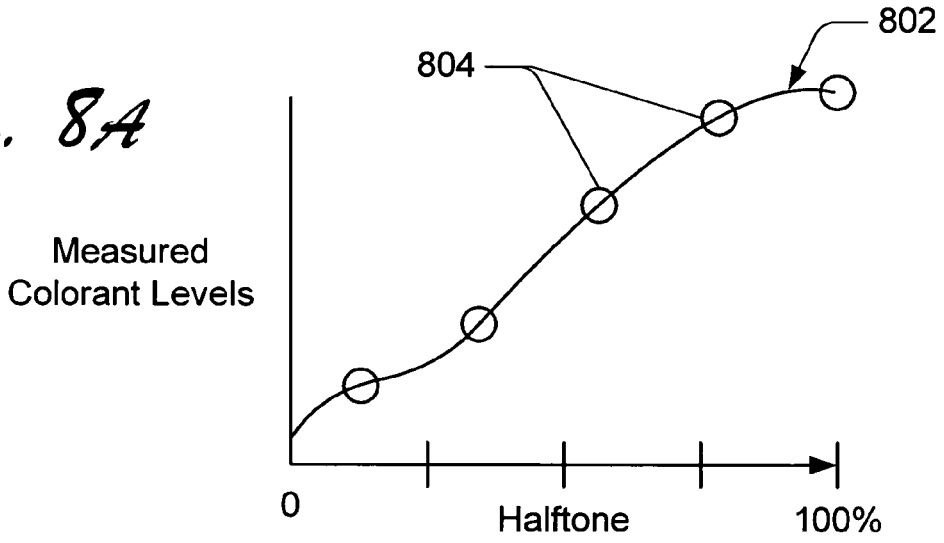
FIGS. 8A–8C illustrate an exemplary implementation of the second calibration mode.
Figure 8B:
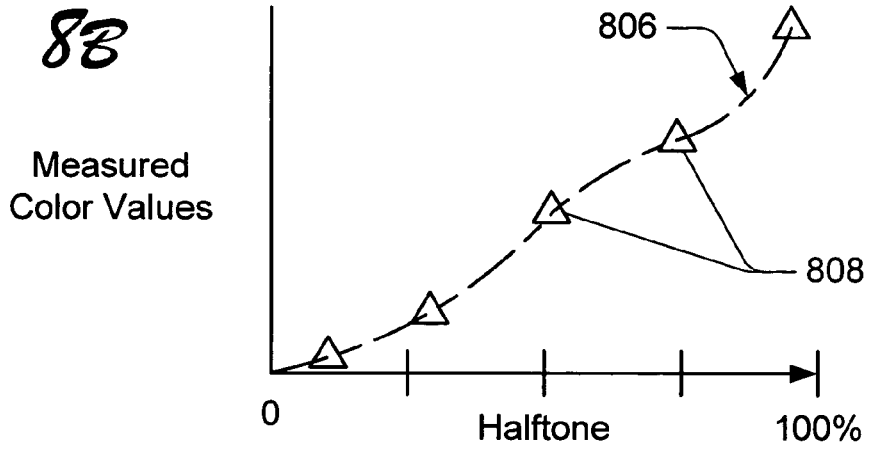
Figure 8C:
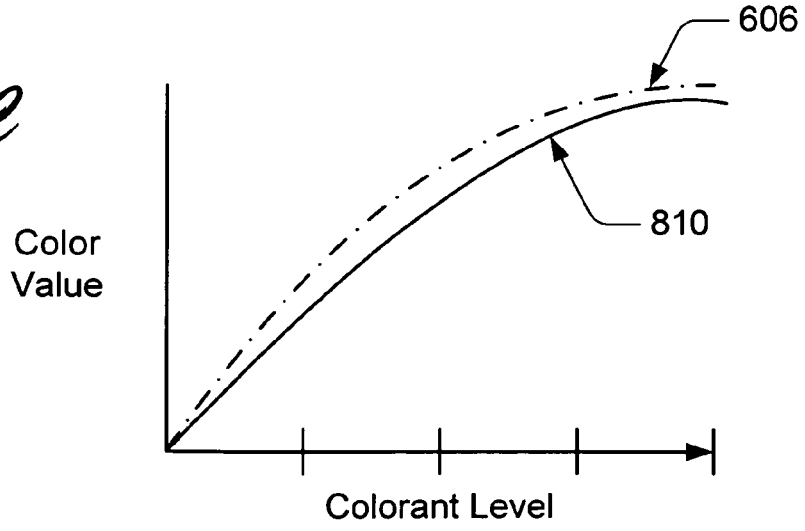

FIGS. 8A–8C illustrate an example of the second calibration mode 304 which is described with reference to method 500 (FIG. 5). In FIG. 8A, a curve fit 802 is generated that corresponds to measured colorant levels 804. For example, the colorant levels are measured when a colorant is applied to a test element and while the colorant is in a pre-fused, or not in a finished state (i.e., blocks 502 and 504 of method 500). In FIG. 8B, a curve fit 806 is generated that corresponds to measured color values 808. For example, the color values are measured after the colorant is printed and formed as a permanent image on a print media (i.e., blocks 506 and 508 of method 500).

FIG. 8C illustrates a correlation 810 that is established between the measured colorant levels 804 and the measured color values 808 (i.e., block 510 of method 500). Also shown for comparison is the correlation 606 (from FIG. 6B) that is replaced in the first calibration mode 302 with the newly established correlation 810.

The first calibration mode 302 can now be used for a period of time to control calibration of the print unit 118, instead of measuring color values of a colorant on the finished print media 210. If the accuracy of the correlation between measuring colorant levels in a pre-fused state and correlating this measurement to color values measured in a finished state degrades, a new correction factor can be reestablished by repeating the second calibration mode 304 (e.g., method 500).

Although embodiments of printing system calibration have been described in language specific to structural features and/or methods, it is to be understood that the subject of the appended claims is not necessarily limited to the specific features or methods described. Rather, the specific features and methods are disclosed as exemplary implementations of printing system calibration.

The invention claimed is:

1. A printing system, comprising:

a print unit configured to apply a colorant to a test element and to a print media; and a calibration system configured to:

measure one or more colorant levels of the colorant applied to the test element before the colorant is in a finished state;

measure one or more color values of the colorant applied to the print media after the colorant is in the finished state;

establish a correlation between the one or more measured colorant levels and the one or more measured color values such that the correlation can be utilized to calibrate the print unit;

convert the one or more measured colorant levels to corresponding one or more predicted color values based on the correlation;

compare the one or more predicted color values to target color values; and calibrate the print unit if a difference between the one or more predicted color values and the target color values exceeds a threshold value.

2. A printing system as recited in claim 1, wherein the test element is a print media transport belt.

3. A printing system as recited in claim 1, wherein the calibration system is further configured to calibrate the print unit to adjust a colorant level of the colorant applied to the test element.

4. A printing system as recited in claim 1, wherein the colorant is in the finished state after being fused onto the print media.

5. A printing system as recited in claim 1, wherein the colorant is in the finished state after being formed as a permanent image on the print media.

6. A printing system as recited in claim 1, wherein the calibration system comprises one or more sensors configured to measure the one or more colorant levels and the one or more color values.

7. A printing system as recited in claim 1, wherein the printing system is a printing device.

8. A printing system, comprising:

a print unit configured to apply a colorant to a test element; and a calibration system configured to:

measure one or more colorant levels of the colorant applied to the test element before the colorant is in a finished state;

convert the one or more measured colorant levels to corresponding one or more predicted color values;

compare the one or more predicted color values to target color values; and calibrate the print unit if a difference between the one or more predicted color values and the target color values exceeds a threshold value.

9. A printing system as recited in claim 8, wherein the test element is a print media transport belt.

10. A printing system as recited in claim 8, wherein the print unit is further configured to apply the colorant to a print media, and wherein the calibration system is further configured to:

measure one or more color values of the colorant applied to the print media after the colorant is in the finished state; and establish a correlation between the one or more measured colorant levels and the one or more measured color values, the one or more predicted color values being based on the correlation.

11. A printing system as recited in claim 10, wherein the colorant is in the finished state after being fused onto the print media.

12. A printing system as recited in claim 10, wherein the colorant is in the finished state after being formed as a permanent image on the print media.

13. A printing system as recited in claim 10, wherein the calibration system comprises one or more sensors configured to measure the one or more colorant levels and the one or more color values.

14. A printing system as recited in claim 10, wherein the printing system is a printing device.

15. A printing system, comprising:

a print unit; and a calibration system configured to calibrate the print unit the calibration system having selectable calibration modes including:

a first calibration mode configured to (i) measure colorant levels of a colorant applied to a test element, (ii) convert the measured colorant levels to predicted color values, (iii) compare the predicted color values to target color values, and (iv) calibrate the print unit to adjust a colorant level applied to the test element if a difference between the predicted color values and the target color values exceeds a threshold value; and a second calibration mode configured to (i) measure color values of the colorant applied to a print media after the colorant is in a finished state, and (ii) establish a correlation between the measured colorant levels and the measured color values.

16. A printing system as recited in claim 15, wherein the second calibration mode is selected less frequently than the first calibration mode to calibrate the print unit.

17. A printing system as recited in claim 15, wherein the calibration system comprises one or more optical sensors configured to measure the colorant levels and the color values.

18. A printing system as recited in claim 15, wherein the print unit is configured to fuse the colorant on to the print media such that the colorant is in the finished state.

19. A printing system as recited in claim 15, wherein the print unit is configured to form the colorant as a permanent image on to the print media in the finished state.

20. A printing system as recited in claim 15, wherein the printing system is a printing device.

21. One or more computer-readable media comprising computer-executable instructions that, when executed, direct a printing device to:

measure colorant levels of a colorant applied to a test element before the colorant is in a finished state;

measure color values of the colorant applied to a print media after the colorant is in the finished state;

establish a correlation between the measured colorant levels and the measured color values such that the correlation can be utilized to calibrate a print unit;

convert the measured colorant levels to corresponding predicted color values based on the correlation;

compare the predicted color values to target color values; and calibrate the print unit if a difference between the predicted color values and the target color values exceeds a threshold value.

22. One or more computer-readable media as recited in claim 21, further comprising computer-executable instructions that, when executed, direct the printing device to calibrate the print unit to adjust a colorant level of the colorant applied to the test element.

23. One or more computer-readable media as recited in claim 21, further comprising computer-executable instructions that, when executed, direct the printing device to operate in conjunction with a calibration system.

24. A method, comprising:

measuring colorant levels of a colorant applied to a test element before the colorant is in a finished state;

measuring color values of the colorant applied to a print media after the colorant is in the finished state;

establishing a correlation between the measured colorant levels and the measured color values such that the correlation can be utilized to calibrate a print unit;

converting the measured colorant levels to corresponding predicted color values based on the correlation;

comparing the predicted color values to target color values; and calibrating a print unit if a difference between the predicted color values and the target color values exceeds a threshold value.

25. A method as recited in claim 24, further comprising fusing the colorant applied to the print media to form the colorant in the finished state.

26. A method as recited in claim 24, further comprising forming the colorant as a permanent image on the print media in the finished state.

27. A method as recited in claim 24, further comprising measuring the colorant levels and the color values with one or more sensors.

28. A method, comprising:

measuring colorant levels of a colorant applied to a test element before the colorant is in a finished state;

converting the measured colorant levels to corresponding predicted color values;

comparing the predicted color values to target color values; and calibrating a print unit if a difference between the predicted color values and the target color values exceeds a threshold value.

29. A method as recited in claim 28 further comprising:

measuring color values of the colorant applied to a print media after the colorant is in the finished state; and establishing a correlation between the measured colorant levels and the measured color values.

30. A method as recited in claim 29, further comprising fusing the colorant applied to the print media to form the colorant in the finished state.

31. A method as recited in claim 29, further comprising forming the colorant as a permanent image on the print media in the finished state.

32. A method as recited in claim 29, further comprising measuring the colorant levels and the color values with one or more sensors.

33. A method for calibrating a printer comprising selecting one or more calibration modes, wherein:

a first calibration mode includes:

measuring colorant levels of a colorant applied to a test element;

converting the measured colorant levels to predicted color values;

comparing the predicted color values to target color values;

calibrating the printer if a difference between the predicted color values and the target color values exceeds a threshold value; and a second calibration mode includes:

measuring color values of the colorant applied to a print media after the colorant is in a finished state; and establishing a correlation between the measured colorant levels and the measured color values.

34. A method, comprising:

measuring colorant levels of a colorant applied on a test element;

printing the colorant on a print media;

forming the colorant as a permanent image on the print media;

measuring color values of the colorant formed as the permanent image on the print media;

establishing a correlation between the measured colorant levels and the measured color values;

converting the measured colorant levels to corresponding predicted color values based on the correlation;

comparing the predicted color values to target color values; and calibrating a print unit if a difference between the predicted color values and the target color values exceeds a threshold value.

35. One or more computer-readable media comprising computer-executable instructions that, when executed, direct a printing device to:

deposit colorant onto a test element;

measure colorant levels of the colorant in a pre-fused state;

print the colorant on a print media;

form the colorant as a permanent image on the print media;

measure color values of the colorant formed as the permanent image on the print media;

establish a correlation between the measured colorant levels and the measured color values;

convert the measured colorant levels to corresponding predicted color values based on the correlation;

compare the predicted color values to target color values; and calibrate a print unit if a difference between the predicted color values and the target color values exceeds a threshold value.

36. A system for calibrating a printing device, comprising:

means for depositing colorant onto a print media and onto a test element;

means for forming the colorant as a permanent image on the print media;

means for measuring colorant levels of the colorant deposited on the test element, and for measuring color values of the colorant after being formed as a permanent image on the print media;

means for establishing a correlation between the measured colorant levels and the measured color values;

means for convening measured colorant levels to corresponding predicted color values based on the correlation;

means for comparing the predicted color values to target color values; and means for calibrating a print unit if a difference between the predicted color values and the target color values exceeds a threshold value.

* * * * *

UNITED STATES PATENT AND TRADEMARK OFFICE

CERTIFICATE OF CORRECTION

PATENT NO. : 7,152,941 B2
APPLICATION NO. : 10/695492
DATED : December 26, 2006
INVENTOR(S) : David A. Johnson It is certified that error appears in the above-identified patent and that said Letters Patent is hereby corrected as shown below:

In column 3, line 6, delete “calorimeters,” and insert -- colorimeters, --, therefor.

In column 12, line 5, in Claim 15, delete “unit” and insert -- unit, --, therefor.

In column 13, line 30, in Claim 29, delete “claim 28” and insert -- claim 28, --, therefor.

In column 14, line 51, in Claim 36, delete “convening” and insert -- converting --, therefor.

Signed and Sealed this

Twenty-fifth Day of November, 2008

JON W. DUDAS
*Director of the United States Patent and Trademark Office*